US005565307A

United States Patent [19]

Hioki et al.

[11] Patent Number: 5,565,307

[45] Date of Patent: Oct. 15, 1996

[54] SILVER HALIDE PHOTOGRAPHIC MATERIAL, METHOD FOR EXPOSING THE SAME, AND METHOD FOR PROCESSING THE SAME

[75] Inventors: Takanori Hioki; Toyohisa Oya; Seiichi Yamamoto, all of Kanagawa, Japan

[73] Assignee: Fuji Photo Film Co., Ltd., Kanagawa, Japan

[21] Appl. No.: 423,852

[22] Filed: Apr. 18, 1995

[30] Foreign Application Priority Data

Apr. 19, 1994 [JP] Japan ..... 6-103244

[51] Int. Cl.[6] ..... G03C 1/20

[52] U.S. Cl. ..... 430/363; 430/401; 430/434; 430/570; 430/577; 430/963

[58] Field of Search ..... 430/577, 581, 430/945, 963, 434, 401, 430, 363, 570

[56] References Cited

U.S. PATENT DOCUMENTS

| | | | |
|---|---|---|---|
| 4,917,997 | 4/1990 | Ikeda et al. | 430/572 |
| 5,116,722 | 5/1992 | Callant et al. | 430/363 |
| 5,348,850 | 9/1994 | Yushida et al. | 430/575 |

FOREIGN PATENT DOCUMENTS 359637 3/1991 Japan .

*Primary Examiner*—Thorl Chea
*Attorney, Agent, or Firm*—Sughrue, Mion, Zinn, Macpeak & Seas

[57] ABSTRACT

Disclosed are a silver halide photographic material containing at least one merocyanine color-sensitizing dye having a particular structure of formula (I)

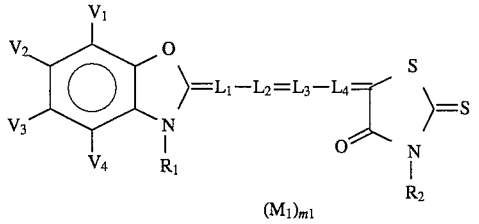

(I)

wherein $R_1$ and $R_2$ each represent an alkyl group having a residue capable of making the compound soluble in water as a free acid or salt; $V_1$, $V_2$, $V_3$ and $V_4$ each represent a hydrogen atom or a monovalent substituent, provided that these substituents ($V_1$, $V_2$, $V_3$, $V_4$) are not bonded to each other to form a ring and that the sum of the molecular weights of $V_1$, $V_2$, $V_3$ and $V_4$ is from 4 to 50; $L_1$, $L_2$, $L_3$ and $L_4$ each represent an optionally substituted methine group; $M_1$ represents a charge-neutralizing pair ion; and $m_1$ represents a number of from 0 to 4 that is necessary for neutralizing the intramolecular charge.

7 Claims, No Drawings

SILVER HALIDE PHOTOGRAPHIC MATERIAL, METHOD FOR EXPOSING THE SAME, AND METHOD FOR PROCESSING THE SAME

FIELD OF THE INVENTION

The present invention relates to a high-sensitivity silver halide photographic material which is highly sensitive and yield little residual color after processed, a method for exposing it and a method for processing it.

More precisely, the present invention relates to a silver halide photographic material which is highly sensitive to scanning exposure using at least two or more laser rays having an oscillation wavelength of from 620 to 690nm (preferably, He—Ne laser ray (633nm) and semiconductor layer rays (670nm±10nm)) and which can be processed while adding reduced amounts of replenishers to the processing solutions or can be processed rapidly to yield little residual color on the processed material. It also relates to a method for exposing the material and to a method for processing the material.

BACKGROUND OF THE INVENTION

Recently, scanner systems have been widely employed in the printing field. Various light sources have been put to practical use in recording devices for forming images by scanner systems.

In particular, laser rays having an oscillation wavelength of from 620 to 690nm are advantageously employed. Of these, a He—Ne laser (having an oscillation wavelength of 633nm) and a semiconductor laser (having an oscillation wavelength of about 670nm or so) have been popularized, as being excellent in the stability and the ability of forming high-quality images. Since each point on the photographic material to be subjected to scanning exposure is exposed for a short period of time of from $10^{-7}$ to $10^{-3}$ seconds, the material is needed to be highly sensitive even to such short-time exposure to be able to form an image having a high contrast.

Photographic materials which are highly sensitive to at least two or more laser rays having an oscillation wavelength of from 620 to 690nm (preferably, a He—Ne laser ray (633nm and a semiconductor layer ray (670nm±10nm)) are very advantageous, since one and the same material of these can be applied to at least two or more recording devices having the corresponding light sources. Therefore, the development of such photographic materials has been desired.

For instance, JP-A-3-59637 (the term "JP-A" as used herein means an "unexamined published Japanese patent application") discloses a rapidly-processable photographic material to be exposed to a He—Ne light source, which contains a carbocyanine or rhodacyanine spectral sensitizing dye and in which the amount of gelatin in the emulsion layer and that in the protective layer are specifically controlled.

However, since carbocyanine dyes have a narrow spectral sensitivity distribution, it is difficult to provide a photographic material which contains such a carbocyanine dye and which is highly sensitive to two or more lasers each having a different oscillation wavelength range.

On the other hand, rhodacyanine dyes have a broader color sensitivity distribution than carbocyanine dyes but are still unsatisfactory.

U.S. Pat. No. 5,116,722 discloses a silver halide photographic material containing a particular tri-nuclear merocyanine spectral sensitizing dye, which is exposed to a light source having a wavelength range of from 600 to 690nm.

However, the material disclosed in said U.S. patent specification, though having a relatively broad spectral sensitivity, is not sufficiently satisfactory in its sensitivity and residual color due to the spectral sensitizing dye after processing the material.

All of these conventional photographic materials are not satisfactory in that, when the amounts of the replenishers to the processing solutions are reduced in processing the materials or when the materials are processed rapidly, residual color is increased.

Given the situations, the development of a high-sensitivity silver halide photographic material, which has a broad and gentle spectral sensitivity distribution within a wavelength range of from 620 to 690nm and which yield little residual color after processed, has been strongly desired.

SUMMARY OF THE INVENTION

The object of the present invention is to provide a high-sensitivity silver halide photographic material, which yield little residual color after processed, and also to a method for exposing it and a method for processing it.

In particular, the present invention is to provide a method for exposing a high-sensitivity silver halide photographic material having a broad color sensitivity distribution and having a color sensitivity peak preferably within a range of from 640 to 670nm, which is characterized in that the material is exposed to at least two or more laser rays having an oscillation wavelength of from 620 to 690nm (preferably He—Ne laser ray and semiconductor layer ray (having an oscillation wavelength of 670nm±10nm)).

In addition, the present invention is to provide a method for processing a high-sensitivity silver halide photographic material while adding reduced amounts of replenishers to the processing solutions or for rapidly processing it. The thus-processed material yield little residual color The object of the present invention has been attained by a silver halide photographic material containing at least one compound represented by formula (I)

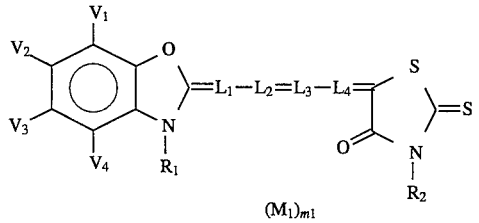

(I)

wherein $R_1$ and $R_2$ each represent an alkyl group having a group capable of making the compound soluble in water as a free acid or a salt;

$V_1$, $V_2$, $V_3$ and $V_4$ each represents a hydrogen atom or a monovalent substituent, provided that these substituents ($V_1$, $V_2$, $V_3$, $V_4$) are not bonded to each other to form a ring and that the sum of the molecular weights of $V_1$, $V_2$, $V_3$ and $V_4$ is from 4 to 50;

$L_1$, $L_2$, $L_3$ and $L_4$ each represents which may be substituted;

$M_1$ represents a charge-neutralizing pair ion; and $m_1$ represents a number of from 0 to 4 that is necessary for neutralizing the intramolecular charge.

DETAILED DESCRIPTION OF THE INVENTION

Compounds of formula (I) for use in the present invention will be described in detail hereunder.

In formula (I), $R_1$ and $R_2$ each represents an alkyl group having a group capable of making the compound water-soluble as a free acid or salt. The water-solubility as referred to herein means such that at least 0.5 g of the compound are soluble in one liter of water at room temperature (25° C.).

Specific examples of $R_1$ and $R_2$ are as follows:

$$-Q_3-CO_2M$$
$$-Q_3-SO_3M$$
$$-Q_3-\overset{\overset{\displaystyle O}{\|}}{C}NSO_2R_{10}\ (M)$$
$$-Q_3-PO_3M$$

In these formulae, $Q_3$ represents a divalent linking group including an alkylene group, M represents a hydrogen atom, an ammonium group, an alkali metal atom (e.g., sodium, potassium), an alkaline earth metal atom (e.g., calcium), or an organic amine salt (e.g., triethylamine salt, 1,8-diazabicyclo[5.4.0]-7-undecene salt) (the same shall apply to M to be referred to hereinafter); and $R_{10}$ represents an alkyl group or an aryl group.

$Q_3$ is preferably an alkylene group having from 1 to 20 carbon atoms (hereinafter referred to as C atoms) (e.g., methylene, ethylene, propylene, butylene, pentylene).

The divalent alkylene linking group of $Q_3$ may have one or more of an amido bond (—NHCO—), an ester bond (—COO—), a sulfonamido bond (—$NHSO_2$—), a sulfonato bond (—$SO_2O$—), an ureido bond (—NHCONH—), a sulfonyl bond (—$SO_2$—), a sulfinyl bond (—SO—), a thioether bond (—S—), an ether bond (—O—), a carbonyl bond (—CO—) and an amino bond (—NH—).

Specific examples of $Q_3$ are mentioned below.

$$-(CH_2)_n- \quad n=1\sim5$$
$$-(CH_2)_2-\underset{\underset{\displaystyle CH_3}{|}}{CH}-$$
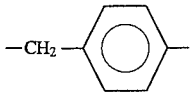
$$-CH_2CO_2(CH_2)_2-$$
$$-CH_2\overset{\overset{\displaystyle OH}{|}}{C}HCH_2-$$
$$-CH_2\overset{\overset{\displaystyle O}{\|}}{C}NH-(CH_2)_2-$$
$$-(CH_2)_2\overset{\overset{\displaystyle O}{\|}}{C}NHCNH(CH_2)_2-$$

In addition to these, the linking groups described in European Patent 472,004, pp. 5 to 7 are also employed.

More preferably, $Q_3$ is an alkylene group having from 1 to 10 C atoms; and even more preferably, it is an alkylene group having from 1 to 6 C atoms. Especially preferably, $Q_3$ is a methylene group, an ethylene group, a propylene group or a butylene group.

$R_{10}$ is preferably an alkyl group having from 1 to 10 C atoms (e.g., methyl, ethyl, hydroxyethyl), or an aryl group having from 6 to 12 C atoms (e.g., phenyl, 4-chlorophenyl).

$V_1$, $V_2$, $V_3$ and $V_4$ each may be any of a hydrogen atom and a monovalent substituent. Preferably, they each are a hydrogen atom, an unsubstituted alkyl group (preferably having from 1 to 3 C atoms, e.g., methyl, ethyl, propyl), a substituted alkyl group (preferably having 1 or 2 C atoms, e.g., hydroxymethyl), an alkoxy group (preferably having from 1 to 3 C atoms, e.g., methoxy, ethoxy), a fluorine atom, a chlorine atom, a hydroxyl group, an acetyl group, a carbamoyl group, a carboxyl group, or a cyano group.

More preferably, $V_1$, $V_2$, $V_3$ and $V_4$ each represents a hydrogen atom, an alkyl group having 1 or 2 C atoms, an alkoxy group having 1 or 2 C atoms, a hydroxyl group, an acetyl group, a fluorine atom, or a chlorine atom, and even more preferably, they each represents a hydrogen atom, a methyl group or a methoxy group, especially preferably, a hydrogen atom.

The sum of the molecular weights of $V_1$, $V_2$, $V_3$ and $V_4$ indicates a number to be obtained by simply totaling the molecular weights of these groups. For instance, when $V_1=V_2=V_3=V_4=H$, the sum of the molecular weights of these groups is 4. When $V_1=V_2=V_4=H$ and $V_3$=phenyl, the sum of the molecular weights of these groups is 77. The sum of the molecular weights of these groups is preferably from 4 to 35, more preferably from 4 to 21, most preferably 4.

$L_1$, $L_2$, $L_3$ and $L_4$ each represents an unsubstituted methine group or a substituted methine group. As examples of the substituent for the substituted methine group, mentioned are a substituted or unsubstituted alkyl group (preferably having from 1 to 5 C atoms, e.g., methyl, ethyl, n-propyl, i-propyl, cyclopropyl, butyl, 2-carboxyethyl), a substituted or unsubstituted aryl group (preferably having from 6 to 12 C atoms, e.g., phenyl, naphthyl, anthryl, p-carboxyphenyl), a heterocyclic group (preferably a 3-membered to 7-membered heterocyclic group having from 2 to 12 C atoms and having hetero atom(s) of S, O, N and/or Se, e.g., pyridyl, thienyl, furano, barbituric acid residue), a halogen atom (e.g., chlorine, bromine), an alkoxy group (preferably having from 1 to 5 C atoms, e.g., methoxy, ethoxy), a substituted or unsubstituted amino group (preferably having from 0 to 12 C atoms, e.g., N,N-diphenylamino, N-methyl-N-phenylamino, N-methylpiperazino), and an alkylthio group (preferably having from 1 to 5 C atoms, e.g., methylthio, ethylthio). Two or more of these methine groups may form a ring which may have be substituted (preferably a 5-membered to 7-membered ring, e.g., cyclohexene ring; the substituent for the ring, not being limited, is preferably an alkyl group (e.g., methyl, ethyl), an alkoxy group (e.g., methoxy), a halogen atom (e.g., chlorine atom) or an aryl group (e.g., phenyl)), or form an auxochrome (e.g., benzoxazole ring).

$L_1$, $L_2$ and $L_4$ are preferably unsubstituted methine groups.

$L_3$ is preferably a methine group substituted by unsubstituted alkyl group(s) (e.g., methyl, ethyl).

$(M_1)m_1$ is in the formula to indicate the presence or absence of cation(s) or anion(s), when it is needed so as to neutralize the ionic charge of the compound (dye) of formula (I). Whether a dye is cationic or anionic or whether or not a dye has net ionic charge(s) depends on its auxochrome and substituents.

Specific examples of the cation include a hydrogen ion, inorganic ammonium ions, organic ammonium ions ( e.g., tetraalkylammonium ions, pyridinium ion), alkali metal ions ( e.g., sodium ion, potassium ion), and alkaline earth metal ions (e.g., calcium ion).

The anion may be any of inorganic anions and organic anions, including, for example, halide anions (e.g., fluoride ion, chloride ion, bromide ion, iodide ion), substituted arylsulfonato ions (e.g., p-toluenesulfonato ion, p-chlorobenzenesulfonato ion), aryldisulfonato ions (e.g., 1,3-benzenedisulfonato ion, 1,5-naphthalenedisulfonato ion, 2,6-naphthalenedisulfonato ion), alkylsulfato ions (e.g., methylsulfato ion, ethylsulfato ion), sulfato ions, thiocyanato ions, perchlorato ions, tetrafluoroborato ions, piclato ions, acetato ions, and trifluoromethanesulfonato ions.

As charge-balancing pair ions, further employable are ionic polymers and other dyes charged oppositely to the dye of formula (I). Also employable are metal complex ions ( e. g., bisbenzene-1,2-dithiolato-nickel(III)).

Of these, preferred are ammonium cations (e.g., triethylamine salt, 1,8-diazabicyclo[5.4.0]-7-undecene salt), and alkali metal ions (e.g., sodium ion, potassium ion). More preferred are alkali metal ions ( e. g., sodium ion, potassium ion). Even more preferred is sodium ion.

Of compounds of formula (I), more preferred are those of the following formula (II).

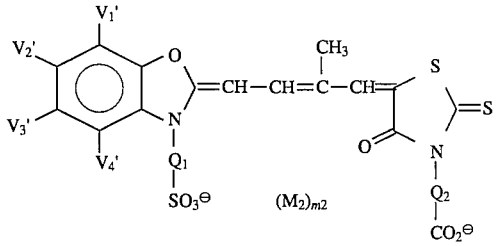

(II)

wherein $Q_1$ and $Q_2$ each represents an alkylene group; $V_1'$, $V_2'$, $V_3'$ and $V_4'$ each represents a hydrogen atom, a methyl group, a methoxy group, a hydroxyl group, an acetyl group, a fluorine atom or a chlorine atom; the sum of the molecular weights of $V_1'$, $V_2'$, $V_3'$ and $V_4'$ is from 4 to 50; $M_2$ represents a charge-neutralizing pair ion; and $m_2$ represents a number of from 0 to 4 that is necessary for neutralizing the intramolecular charge.

In formula (II), especially preferably, $V_1'$, $V_2'$, $V_3'$ and $V_4'$ are all hydrogen atoms.

Compounds of formula (II), especially those where $V_1'$, $V_2'$, $V_3'$, and $V_4'$ are all hydrogen atoms are described in more detail hereunder.

$Q_1$ and $Q_2$ each is preferably an alkylene group having from 1 to 8 C atoms, preferably from 1 to 4 C atoms (e.g., methylene, ethylene, propylene, n-butylene, i-butylene).

$Q_1$ is more preferably an ethylene group. $Q_2$ is more preferably a methylene group. Especially preferably, $Q_1$ is an ethylene group and $Q_2$ is a methylene group.

Examples and preferred examples of $M_1$ may apply to $M_2$. $M_2$ is especially preferably a sodium ion.

Specific examples of compounds of formulae (I) and (II) for use in the present invention are mentioned below, which, however, are not limitative.

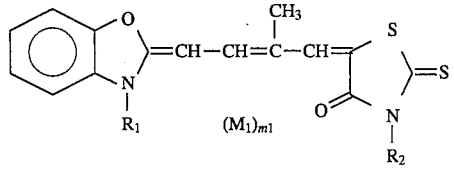

| Compound No. | $R_1$ | $R_2$ | $M_1$ | ml |
|---|---|---|---|---|
| (1) | $(CH_2)_2SO_3^{\theta}$ | $CH_2CO_2^{\theta}$ | $Na^{\oplus}$ | 2 |
| (2) | " | " | $K^{\oplus}$ | " |
| (3) | " | " | $(C_2H_5)_3\overset{\oplus}{N}H$ | " |
| (4) | $(CH_2)_4SO_3^{\theta}$ | " | $K^{\oplus}$ | " |
| (5) | $(CH_2)_3SO_3^{\theta}$ | " | " | " |
| (6) | $(CH_2)_2CH(CH_3)SO_3^{\oplus}$ | " | " | " |
| (7) | $(CH_2)_2SO_3^{\theta}$ | $(CH_2)_2CO_2^{\theta}$ | $Na^{\theta}$ | " |
| (8) | " | $(CH_2)_3CO_2^{\theta}$ | " | " |
| (9) | " | $(CH_2)_5CO_2^{\theta}$ | " | " |

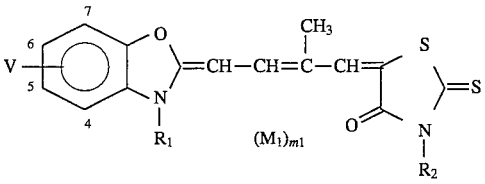

| Compound No. | $R_1$ | $R_2$ | V | $M_1$ | ml |
|---|---|---|---|---|---|
| (10) | $CH_2CO_2^{\theta}$ | $(CH_2)_2SO_2^{\theta}$ | H | $K^{\oplus}$ | 2 |
| (11) | " | $CH_2CO_2^{\theta}$ | " | " | " |
| (12) | $(CH_2)_4SO_3^{\theta}$ | $(CH_2)_2SO_3^{\theta}$ | " | " | " |
| (13) | " | $CH_2CO_2^{\theta}$ | 5-$OCH_3$ | $Na^{\oplus}$ | " |
| (14) | " | " | 5-$CH_3$ | " | " |
| (15) | " | " | 5-$CH_3$ 6-$CH_3$ | " | " |
| (16) | " | " | 5-F | " | " |
| (17) | " | " | 5-Cl | " | " |
| (18) | " | " | 5-OH | " | " |
| (19) | " | " | 5-$COCH_3$ | " | " |

(20)

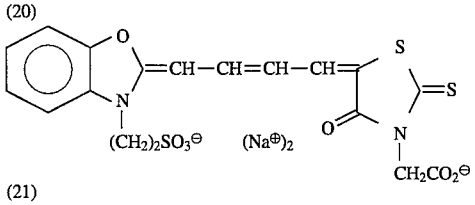

(21)

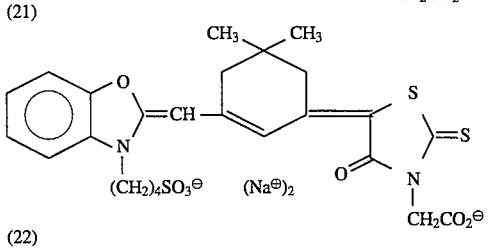

(22)

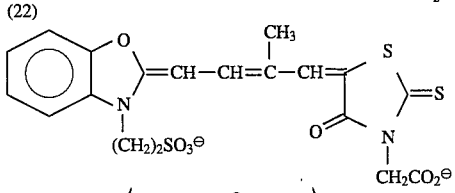

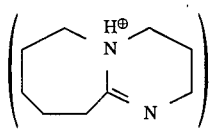

Compounds of formula (I) (including those of formula (II)) can be produced according to the methods described in F. M. Hamer, Heterocyclic Compounds—Cyanine Dyes and Related Compounds (published by John Wiley & Sons Co., New York, London, 1964); D. M. Sturmer, Heterocyclic Compounds—Special Topics in Heterocyclic Chemistry—, Chap. 18, Sec. 14, pp. 482–515 (published by John Wiley &

Sons Co., New York, London, 1977); Rodd's Chemistry of Carbon Compounds, 2nd Ed., Vol. IV, Part B, 1977, Chap. 15, pp. 369–422, ibid., 2nd Ed., Vol. IV, Part B, 1985, Chap. 15, pp. 267–296 (published by Elsevier Science Publishing Company Inc., New York); etc.

One example of producing a compound of formula (I) for use in the present invention is mentioned below. Production Example:

Production of Compound (1):

115 g of 4-{2-(4-ethoxy-3-methyl-1,3-butadienyl)-3-benzoxazolio}ethanesulfonate and 65.2 g of 3-carboxymethylrhodanine were dissolved in 1 liter of acetonitrile, and 143 ml of triethylamine were added thereto and stirred at room temperature for 2 hours. The crystals thus precipitated were taken out by suction filtration to obtain 165 g of a powdery violet product. This is triethylamine salt of compound (1). The crude yield was 83%. The product had a melting point of 235° to 237° C., $\lambda max=572nm$, $\epsilon=7.85\times10^4$ (in methanol).

50 g of the powdery product were dissolved in 1.7 liters of methanol, and 26 g of sodium acetate in 0.7 liters of methanol were added thereto and stirred. The crystals thus formed were taken out by suction filtration to obtain 32 g of a powdery violet product of compound (1). The pure yield was 77%. The product gradually decomposed at 140° C. or higher. This had $\lambda max=568nm$, $\epsilon=7.87\times10^4$ (in methanol).

The other compounds of formula (I) may also be produced in accordance with the above-mentioned production example.

Compounds of formula (I) are preferably used as sensitizing dyes. As other sensitizing dyes than those of formula (I), which are preferably employed in the present invention along with compounds of formula (I), for example, mentioned are the compounds described in F. M. Hamer, Heterocyclic Compounds—Cyanine Dyes and Related Compounds (published by John Wiley & Sons, New York, London, 1964).

Sensitizing dyes, combinations of supersensitizing dyes and supersensitizing substances which are usable in the present invention are described in, for example, Research Disclosure, Vol. 167, No. 17643 (published in December 1978), page 23, Item IV-J, JP-B-49-25500, JP-B-43-4933, JP-A-59-19032, and JP-A-59-192242.

According to the present invention, compounds (dyes) of formula (i) and other sensitizing dyes employable along with compounds of formula (I) are incorporated into the hydrophilic colloid layers constituting the photographic material of the present invention. These are preferably incorporated into silver halide emulsions. For instance, these may be directly dispersed in the emulsions. Alternatively, these are dissolved in a single solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., or in a mixed solvent comprising them, and the resulting solutions may be added to the emulsions.

Also employable in the present invention are a method of dissolving the dye in a volatile organic solvent, dispersing the resulting solution in water or a hydrophilic colloid, and adding the resulting dispersion to a silver halide emulsion, such as that described in U.S. Pat. No. 3,469,987; a method of directly dispersing the water-insoluble dye in a water-soluble solvent, without being dissolved, and adding the resulting dispersion to a silver halide emulsion, such as that described in JP-B-46-24185; a method of dissolving the dye in an acid and adding the resulting solution to a silver halide emulsion, or alternatively, forming the dye into its aqueous solution in the presence of an acid or base and adding the resulting solution to a silver halide emulsion, such as that described in JP-B-44-23389, JP-B-44-27555, and JP-B-57-22091; a method of forming the dye into its aqueous solution or colloidal dispersion in the presence of a surfactant and adding the resulting solution or dispersion to a silver halide emulsion, such as that described in U.S. Pat. Nos. 3,822,135 and 4,006,026; a method of directly dispersing the dye in a hydrophilic colloid and adding the resulting dispersion to a silver halide emulsion, such as that described in JP-A-53-102733 and JP-A-58-105141; a method of dissolving the dye along with a red-shifting compound and adding the resulting solution to a silver halide emulsion, such as that described in JP-A-51-74624, etc.

Ultrasonic waves may be used in dissolving the dyes.

The sensitizing dyes for use in the present invention may be added to silver halide emulsions constituting the photographic material of the present invention at any step for preparing the emulsions that has heretofore been admitted useful. For instance, they may be added to the emulsions any time during the step for forming silver halide grains and/or before the step for de-salting the grains, during the de-salting step and/or after the de-salting step and before the start of chemical ripening of the grains, for example, according to the disclosures in U.S. Pat. Nos. 2,735,766, 3,628,960, 4,183,756, 4,225,666, JP-A-58-184142, JP-A-60-196749, etc.; or any time just before or during the chemical ripening of the grains, or after the chemical ripening of the grains but before the coating of the emulsions, for example, according to the disclosures in JP-A-58-113920, etc. According to the disclosures in U.S. Pat. No. 4,225,666, JP-A-58-7629, etc., if desired, one and the same compound is, singly or along with other compound(s) having different structure(s), added to the grains during the step of forming the grains and additionally during the step of chemically ripening them or after the chemical-ripening step, or added to the grains before, during and after the chemical-ripening step. The kind of the compound and the combination of the plural compounds to be added to the grains several times during, before and after the above-mentioned steps may be varied.

The amount of the sensitizing dye of formula (I) to be added to the silver halide emulsions constituting the photographic material of the present invention varies, depending on the shape and the size of the silver halide grains in the emulsions. Preferably, the amount is from $4\times10^{-8}$ to $8\times10^{-2}$ mols, more preferably from $1\times10^{-7}$ to $1\times10^{-3}$ mols, especially preferably from $1\times10^{-5}$ to $5\times10^{-3}$ mols, per mol of the silver halide in the emulsion.

Methods for processing the silver halide photographic material of the present invention are described hereunder.

The material is imagewise exposed by an ordinary method to obtain a photographic image. Any of various known light sources is employable for the exposure, including, for example, natural light (sunlight), tungsten lamps, fluorescent lamps, mercury lamps, xenon arc lamps, carbon arc lamps, xenon flash lamps, lasers, LED, CRT, etc.

In addition to these, the material may also be exposed to light to be emitted by fluorescent substances excited by electron beams, X rays, $\gamma$ (gamma) ray, $\alpha$ (alpha) ray, etc.

In particular, laser rays are preferably employed in the present invention.

Laser rays include those to be emitted by gaseous laser-oscillating media, such as helium-neon gas, argon gas, krypton gas, carbon dioxide gas, etc., those to be emitted by solid laser-oscillating media, such as ruby, cadmium, etc., as well as liquid lasers, semiconductor lasers. Of these, helium-neon lasers that have a relatively long life and are inexpensive are the most popular.

Different from light emitted by ordinary illuminators, these laser rays are coherent rays with sharp orientation having a single frequency and a uniform phase. Therefore, silver halide photographic materials to be exposed to such laser rays shall have spectral characteristics corresponding to the oscillating wavelength of the laser used.

Preferably, the photographic material of the present invention is exposed with at least one laser source having an oscillating wavelength of from 620nm to 690nm, more preferably with at least two (particularly 2 to 5) such laser sources. Especially preferably, such laser sources to be used for exposing the material are at least two (more particularly preferably 2) laser sources including a He—Ne laser source and a semiconductor laser source having an oscillating wavelength of 670nm±10nm.

In the present invention, the exposure with a laser source is preferably conducted for $10^{-12}$ to $10^{-2}$ second, more preferably $10^{-9}$ to $10^{-3}$ second Methods for processing the photographic material of the present invention will be described in more detail hereunder.

Any and every conventional photographic processing method may be applied to the photographic material of the present invention, in which any known processing solutions can be used. In general, the processing temperature may be selected from 18° C. to 50° C. However, it may be lower than 18° C. or higher than 50° C. According to the object of the photographic material, the material may be subjected to any of black-and-white development for forming silver images and color development for forming color images.

The black-and-white developer for the former may contain one or more known developing agents, such as dihydroxybenzenes (e.g., hydroquinone), 3-pyrazolidones (e.g., 1-phenyl-3-pyrazolidone), aminophenols (e.g., N-methyl-p-aminophenol), etc. Black-and-white developers and fixers that are preferably used in the present invention are described in, for example, JP-A-2-103536, from page 19, right top column, line 16 to page 21, left top column, line 8.

The color developer for the latter color development generally is an alkaline aqueous solution containing color developing agent(s). As the color developing agents, usable are known primary aromatic amine developing agents.

In addition to these, also usable are the compounds described F. A. Mason, Photographic Processing Chemistry (published by Focal Press, 1966), pp. 226 to 229, U.S. Pat. Nos. 2,193,015, 2,592,394, JP-A-48-64933, etc.

The developer may additionally contain a pH buffer such as alkali metal sulfites, carbonates, borates and phosphates; a development inhibitor or an antifoggant such as bromides, iodides and organic antifoggants; etc. If desired, it may also contain a water softener; a preservative such as hydroxylamine; an organic solvent such as benzyl alcohol and diethylene glycol; a development accelerator such as polyethylene glycol, quaternary ammonium salts and amines; a dye-forming coupler; a competing coupler; a foggant such as sodium boronhydride; an auxiliary developing agent such as 1-phenyl-3-pyrazolidone; a tackifier; a polycarboxylic acid type chelating agent such as those described in U.S. Pat. No. 4,083,723; an antioxidant such as those described in German Patent (OLS) 2,622,950; etc.

After having been color-developed, the photographic material is generally bleached. The bleaching may be effected along with or separately from fixation. As the bleaching agent, for example, usable are compounds of poly-valent metals such as iron(III), cobalt(III), chromium(VI), copper(II), etc., as well as peracids, quinones, nitroso compounds, etc.

The bleaching solution or blixer may contain a bleaching accelerator such as those described in U.S. Pat. Nos. 3,042,520, 3,241,966, JP-B-45-8506, JP-B-45-8836, a thiol compound such as those described in JP-A-53-65732, and other various additives. After having been bleached or blixed, the photographic material may be rinsed or may be stabilized without being rinsed.

As one preferred embodiment of the present invention, the compound of formula (I) is added to a black-and-white silver halide photographic material, which is processed with an automatic developing machine while adding from 20 to 500 cc/m$^2$, especially preferably from 50 to 200 cc/m$^2$ of replenishers to the developer bath and the fixer bath. Also preferably, the material is rapidly processed with an automatic developing machine for a total processing time of from 5 to 90 seconds, especially preferably from 15 to 60 seconds.

The details of the automatic developing machine, with which the photographic material of the present invention can be processed, are described in JP-A-4-369643, etc.

Using such an automatic developing machine, the photographic material of the present invention can be processed rapidly or while adding such reduced amounts of replenishers to the processing bathes, and the thus-processed material yield little residual color after processed.

The constitution of the photographic material of the present invention will be described in more detail hereunder.

The silver halide emulsions constituting the photographic material of the present invention may contain any silver halides. Preferably, the emulsions comprise silver chloride, silver chlorobromide or silver iodochlorobromide grains having a silver chloride content of from 50 to 100 mol %, more preferably comprise silver chlorobromide or silver iodochlorobromide grains having a silver chloride content of from 70 to 95 mol%. The silver iodide content in these grains is preferably from 0 to 2 mol %.

The silver halide grains in these emulsions are preferably fine grains having a mean grain size of from 0.1 to 0.7 μm, more preferably from 0.1 to 0.5 μm.

The silver halide grains may be any of cubic, octahedral, tetradecahedral, tabular and spherical grains, and may also be mixtures of these. The grains are preferably cubic grains, octahedral grains and/or tabular grains having an aspect ratio of from 5 to 15.

Regarding the grain size distribution, the emulsions are preferably monodispersed ones.

The monodispersed silver halide emulsions as referred to herein mean that the emulsions have a grain size distribution of from 0 to 20%, especially preferably from 0 to 15%, as the fluctuation coefficient of the grains therein. The fluctuation coefficient (%) is obtained by dividing the standard deviation of the grain size of the silver halide grains in the emulsion by the mean value of the grain size of the same, followed by multiplying the re, suiting quotient by 100.

The photographic emulsions constituting the photographic material of the present invention can be prepared by known methods such as those described in P. Glafkides, Chimie et Physique Photographique (published by Paul Montel, 1967), G. F. Duffin, Photographic Emulsion Chemistry (published by the Focal Press, 1966), V. L. Zelikman, et al., Making and Coating Photographic Emulsion (published by the Focal Press 1964), etc.

Briefly, the emulsions can be produced by any of acid methods, neutral methods, ammonia methods, etc. To prepare the emulsions by reacting soluble silver salts and soluble halides, for example, employable is any of a single jet method, a double jet method and a combination of these.

A so-called reversed mixing method of forming silver halide grains in the presence of excess silver ions may also be employed. As one system of a double jet method, a so-called controlled double jet method may be employed where thee pAg value in the liquid phase to form silver halide grains is kept constant.

According to this method, emulsions of silver halide grains having a regular crystalline form and having almost the same grain size can be obtained.

To form silver halide grains uniform in size, it is preferred to employ a method of varying the speed for adding silver nitrate and alkali halides to the reaction system in accordance with the growing speed of the grains being formed, such as that described in British Patent 1,535,016, JP-B-48-36890, JP-B-52-16364, or a method of varying the concentrations of the aqueous solutions to be added to the reaction system, such as that described in British Patent 4,242,445 and JP-A-55-158124, by which the grains are grown as rapidly as possible without overstepping the critical saturation of the grains being formed.

The silver halide grains may be of a so-called core/shell structure, in which the core and the shell have different halide compositions.

Known rhodium, ruthenium and rhenium compounds can be used in preparing the silver halide grains. Their water-soluble complexes are especially advantageously used. These metals are to have significantly different properties, depending on the ligands in their complexes, as so described in JP-A-2-20852 and JP-A-2-20853. These compounds are employed in the present invention so as to harden the photographic material. As the ligands, preferred are halogens, water molecules, as well as nitrosil and thionitrosil, such as those described in JP-A-2-20852. In the complexes, the pair ions do not have any significant meaning and may be any of ammonium and alkali metal ions. Examples of metal complexes usable in the present invention are mentioned below.

| | | |
|---|---|---|
| $[RhCl_6]^{-3}$ | $[RhCl_5(H_2O)]^{-2}$ | $[RhBr_6]^{-3}$ |
| $[RhCl_5(NS)]^{-2}$ | $[RhCl_5(NO)]^{-2}$ | $[Rh(CN)_5(H_2O]^{-2}$ |
| $[RhF_6]^{-3}$ | $[Rh(NO)Cl(CN)_4]^{-2}$ | |
| $[ReCl_6]^{-3}$ | $[Re(NO)(CN)_5]^{-2}$ | $[Re(NO)CL_5]^{-2}$ |
| $[ReBr_6]^{-3}$ | $[ReCl_5(NS)]^{-2}$ | $[Re(CN)_5(H_2O)]^{-2}$ |
| $[RuBr_6]^{-3}$ | $[Ru(NO)(CN)_5]^{-2}$ | $[Ru(NO)Cl_5]^{-2}$ |
| $[RuBr_6]^{-3}$ | $[RuCl_5(NS)]^{-2}$ | $[Ru(CN)_5(H_2O)]^{-2}$ |

These metal compounds are dissolved in water or suitable solvents, and the resulting solutions are added to the silver halide grains. To stabilize the solutions of these metal compounds, employable is a method of adding thereto an aqueous solution of a hydrogen halide (e.g., hydrochloric acid, hydrobromic acid, hydrofluoric acid, etc.) or an alkali halide (e.g., KCl, NaCl, KBr, NaBr, etc.), which is well known in this technical field. In place of adding such water-soluble salts, it is also possible to add different silver halide grains that have already been doped with any of the metals to the reaction system where the silver halide grains are formed.

The total amount of the metal compound which is preferably added to the silver halide grains for use in the present invention is suitably from $5\times10^{-9}$ to $1\times10^{-4}$ mols, preferably from $1\times10^{-8}$ to $1\times10^{-6}$ mols, most preferably from $5\times10^{-8}$ to $5\times10^{-7}$ mols, per mol of the silver halide in the final grains.

These metal compounds may be added at any time during the preparation of the silver halide emulsions or before coating the emulsions. Especially preferably, they are added during the preparation of the emulsions and are incorporated into the silver halide grains formed. These metal compounds may be combined with other metal compounds having any other metal of the Group VIII than the above-mentioned metals. Especially advantageously employed are mixtures of two or three metal compounds containing any of iridium salts and iron salts.

Water-soluble iridium compounds are preferably employed in the present invention. For instance, employable are iridium(III) halides, iridium(IV) halides, iridium complex salts having, as the ligands, halogens, amines, oxalato, etc., such as hexachloroiridium(III) or (IV) complex salt, hexamine-iridium(III) or (IV) complex salt, trioxalato-iridium(III) or (IV) complex salt, etc. In the present invention, III-valent and IV-valent compounds of these may be combined freely. These iridium compounds are dissolved in water or suitable solvents, and the resulting solutions are added to the silver halide grains. To stabilize the solutions of these iridium compounds, employable is a method of adding thereto an aqueous solution of a hydrogen halide (e.g., hydrochloric acid, hydrobromic acid, hydrofluoric acid, etc.) or an alkali halide (e.g., KCl, NaCl, KBr, NaBr, etc.), which is well known in this technical field. In place of adding such water-soluble iridium compounds to the silver halide emulsions, it is also possible to add different silver halide grains that have already been doped with iridium to the reaction system where the silver halide grains are formed.

The total amount of the iridium compound which is preferably added to the silver halide grains for use in the present invention is suitably from $1\times10^{-8}$ to $1\times10^{-6}$ mols, preferably from $5\times10^{-8}$ to $1\times10^{-6}$ mols, per mol of the silver halide in the final grains. Addition of more than $10^{-6}$ mols of the iridium compound is not preferred, as causing desensitization of the emulsions containing the silver halide grains.

The iridium compound may be added at any time during the preparation of the silver halide emulsions or before coating the emulsions. Especially preferably, it is added during the preparation of the emulsions and is incorporated into the silver halide grains formed.

As preferred examples of the iridium compound for use in the present invention, mentioned are iridium halides, amine salts and oxalato complex salts, such as iridium(III) chloride, iridium(III) bromide, iridium(IV) chloride, sodium hexachloroiridate(III), hexachloroiridium(III) salts, hexamine iridium(IV) salts, trioxalatoiridium(III) salts, trioxalatoiridium (IV) salts, etc.

The silver halide emulsions for use in the present invention are preferably sensitized with selenium sensitizers. For the sensitization, known selenium compounds may be used. In general, unstable and/or non-unstable selenium compounds are added to the emulsions, which are then stirred at high temperatures of 40° C. or higher for a predetermined period of time whereby the emulsions are chemically sensitized. As unstable selenium compounds, usable are those described in JP-B-44-15748, JP-B-43-13489, JP-A-4-109240, JP-A-4-324854, etc. Preferred are the compounds described in JP-A-4-324854.

The silver halide emulsions for use in the present invention may be sensitized with tellurium sensitizers. Tellurium sensitizers form silver telluride, which is presumed to be a sensitizing nucleus, on the surfaces or in the cores of silver halide grains in the emulsions.

As examples of tellurium sensitizers usable in the present invention, mentioned are the tellurium compounds described in U.S. Pat. Nos. 1,623,499, 3,320,069, 3,772,031; British Patents 235,211, 1,121,496, 1,295,462, 1,396,696; Canadian Patent 800,958; JP-A-4-204640, JP-A-4-271341, JP-A-4-

333043, JP-A-5-303157; Journal of Chemical Society Chemical Communication, 635 (1980); ibid., 1102 (1979); ibid., 645 (1979); Journal of Chemical Society Perkin Transaction, 1, 2191 (1980); S. Patai, The Chemistry of Organic Selenium and Tellurium Compounds, Vol. 1 (1986); ibid., Vol. 2 (1987).

The amount of the selenium sensitizer and the tellurium sensitizer to be added to the photographic emulsions for use in the present invention vary, depending on the chemical ripening conditions for the silver halide grains to be sensitized therewith. In general, the sensitizers are added in an amount of approximately from $10^{-8}$ to $10^{-2}$ mols, preferably approximately from $10^{-7}$ to $10^{-3}$ mols, per mol of the silver halide to be sensitized therewith.

The chemical sensitizing conditions for the photographic emulsions for use in the present invention are not specifically defined. In general, the pH of the emulsions to be sensitized may be from 5 to 8, the pAg thereof may be from 6 to 11, preferably from 7 to 10, and the temperature thereof may be from 40° to 95° C., preferably from 45° to 85° C.

It is preferred that the emulsions for use in the present invention are sensitized with the above-mentioned sensitizers along with noble metal sensitizers such as gold, platinum, palladium and iridium compounds. Gold sensitizers are especially preferably employed. As examples of usable gold sensitizers, mentioned are chloroauric acid, potassium chloroaurate, potassium aurithiocyanate, gold sulfide, etc. The amount of the gold sensitizer to be added to the silver halide emulsion of the present invention may be approximately from $10^{-7}$ to $10^{-2}$ mols per mol of the silver halide in the emulsion.

It is also preferred that the emulsions for use in the present invention are sensitized with the above-mentioned sensitizers along with sulfur sensitizers. As sulfur sensitizers, usable are known unstable sulfur compounds, such as thiosulfates (e.g., hypo), thioureas (e.g., diphenylthiourea, triethylthiourea, allylthiourea), rhodanines, etc. The sulfur sensitizer is added to the emulsion in an amount of approximately from $10^{-7}$ to $10^{-2}$ mols per mol of the silver halide in the emulsion.

Additives to be added to the photographic material of the present invention and to the processing solutions to be used for processing the material are not specifically defined. For example, those referred to in the following references are preferably employed. In particular, the nucleating agents and the nucleation accelerators mentioned in the following item 5) are preferably employed.

| Item | References |
|---|---|
| 1) Silver Halide Emulsions and Methods for Preparing Them | JP-A-2-97937, from page 20, right bottom column, line 12 to page 21, left bottom column, line 14; JP-A-2-12236, from page 7, right top column, line 19 to page 8, left bottom column, line 12 |
| 2) Color Sensitizing Dyes Usable along with Compounds of Formula (I) | JP-A-2-55349, from page 7, left top column, line 8 to page 8 right bottom column, line 8; JP-A-2-39042, from page 7, right bottom column, line 8 to page 13, right bottom column, line 5 |
| 3) Antifoggants, Stabilizers | JP-A-2-103536, from page 17, right bottom column, line 19 to page 18, right top column, line 4, page 18, right bottom column, lines 1 to 5. Polyhydroxybenzenes described in JP-A-2-55349, page 11, from left top column, line 9 to right bottom column, line 17 are especially advantageous. |
| 4) Dyes | JP-A-2-103536, from page 17, right bottom column, line 1 to page 18; JP-A-2-39042, from page 4, right top column, line 1 to page 6, right top column, line 5 |
| 5) Hydrazine Nucleating Agents, Nucleation Accelerators | JP-A-2-12236, from page 2, right top column, line 19 to page 7, right top column, line 3; JP-A-2-103536, from page 9, right top column, line 13 to page 16, left top column, line 10 |
| 6) Surfactants, Antistatic Agents | JP-A-2-12236, page 9, from right top column, line 7 to right bottom column, line 7; JP-A-2-18452, from page 2, left bottom column, line 13 to page 4, right bottom column, line 18 |
| 7) Compounds with Acid Group(s) | JP-A-2-103536, from page 18, right bottom column, line 6 to page 19, left top column, line 1; JP-A-2-55349, from page 8, right bottom column, line 13 to page 11, left top column, line 8 |
| 8) Hardening Agents | JP-A-2-103536, page 18, right top column, lines 5 to 17 |
| 9) Mat Agents, Lubricants, Plasticizers | JP-A-2-103536, page 19, from left top column, line 15 to right top column, line 15 |
| 10) Polymer Latexes | JP-A-2-103536, page 18, left bottom column, lines 12 to 20 |
| 11) Binders | JP-A-2-18542, page 3, right bottom column, lines 1 to 20 |

The photographic material of the present invention may contain dyes, which will be described in more detail hereunder.

The photographic material of the present invention may contain colloidal silver or dyes for anti-irradiation, antihalation, and I especially for separating the constitutive photographic layers with respect to the color sensitivity distribution and for ensuring the safety to safelight.

As dyes usable in the present invention for these purposes, for example, mentioned are oxonole dyes having pyrazolone nuclei, barbituric nuclei barbituric acid nuclei, such as those described in British Patents 506,385, 1,177,429, 1,131,884, 1,338,799, 1,385,371, 1,467,214, 1,438,102, 1,553,516, JP-A-48-85130, JP-A-49-114420, JP-A-52-117123, JP-A-55-161233, JP-A-59-111640, JP-B-39-22069, JP-B-43-13168, JP-B-62-273527, U.S. Pat. Nos. 3,247,127, 3,469,985, 4,078,933, etc.; other oxonole dyes such as those described in U.S. Pat. Nos. 2,533,472, 3,379,533, British Patents 1,278,621, JP-A-1-134447, JP-A-1-183652, etc.; azo dyes such as those described in British Patents 575,691, 680,631, 599,623, 786,907, 907,125, 1,045,609, U.S. Pat. Nos. 4,255,326, JP-A-59-211043, etc.; azomethine dyes such as those described in JP-A-50-100116, JP-A-54-118247, British Patents 2,014,598, 750,031, etc.; anthraquinone dyes such as those described in U.S. Pat. No. 2,865,752, etc.; arylidene dyes such as those described in U.S. Pat. Nos. 2,538,009, 2,688,541, 2,538,008, British Patents 584,609, 1,210,252, JP-A-50-40625, JP-A-51-3623, JP-A-51-10927, JP-A-54-118247, JP-B-48-3286, JP-B-59-37303, etc.; styryl dyes such as those described in JP-B-28-3082, JP-B-44-16594, JP-B-59-28898, etc.; triarylmethane dyes such as those described in British Patents 446,538, 1,335,422, JP-A-59-228250, etc.; merocyanine dyes such as those described in British Patents 1,075,653, 1,153,341, 1,284,730, 1,475,228, 1,542,807, etc.; and cyanine dyes such as those described in U.S. Pat. Nos. 2,843,486, 3,294,539, JP-A-1-291247, etc.

In order to prevent these dyes from diffusing in the photographic material, the following methods may be employed. As one method, ballast groups are introduced into the dyes to thereby make the dyes non-diffusive.

Also employable is a method of adding to the photographic layer a hydrophilic polymer charged oppositely to the dissociated anionic dye existing in the layer, by which the dye molecules are localized in the particular layer due to the interaction between the polymer and the dye molecule, such as that disclosed in U.S. Pat. Nos. 2,548,564, 4,124,386, 3,625,694, etc.

Also employable is a method of dyeing a particular layer with a water-insoluble solid dye, such as that described in JP-A-56-12639, JP-A-55-155350, JP-A-55-155351, JP-A-63-27838, JP-A-63-197943, European Patent 15,601, etc.

Also employable is a method of dyeing a particular layer with fine grains of a metal salt to which dye molecules have adsorbed, such as that described in U.S. Pat. Nos. 2,719,088, 2,496,841, 2,496,843, JP-A-60-45237, etc.

The present invention will be described in more detail by means of the following examples, which, however, are not intended to restrict the scope of the present invention.

EXAMPLE 1

Solution 2-a and solution 2-b shown in Table 1 below were added to solution 1 also shown in Table 1, that had been kept at 38° C. and at pH of 4.5, with stirring by a double jet method over a period of 16 minutes, thereby forming cores. Solution 3-a and solution 3-b also shown in Table 1 were added thereto over a period of 16 minutes, thereby forming shells over the cores. 0.15 g of potassium iodide were added thereto to complete the formation of the intended grains.

Afterwards, the grains were washed with water by conventional flocculation. 30 g of gelatin were added thereto. The resulting emulsion was adjusted at pH of 5.6 and at pAg of 7.5. Compound (P) mentioned below, sodium thiosulfate and chloroauric acid were added thereto, and the emulsion was chemically sensitized at 60° C. to have the highest sensitivity. 20 mg of a stabilizer, 4-hydroxy-6-methyl-1,3,3a,7-tetrazaindene and 100 ppm of an antiseptic, phenoxyethanol were added thereto. Finally obtained was an emulsion of cubic silver iodochlorobromide grains having a silver chloride content of 80 mol %, a mean grain size of 0.20 μm and a fluctuation coefficient of 9% (emulsion A).

| Solution | Component | Amount |
|---|---|---|
| Solution 1 | Water | 1 liter |
| | Gelatin | 20 g |
| | Sodium Chloride | 2 g |
| | 1,3-Dimethylimidazolidinone-2-thione | 20 mg |
| | Sodium Benzenethiosulfonate | 6 mg |
| Solution 2-a | Water | 300 ml |
| | Silver-Nitrate | 100 g |
| Solution 2-b | Water | 300 ml |
| | Sodium Chloride | 23 g |
| | Potassium Bromide | 10 g |
| | Potassium Hexachloroiridate(III) (0.001%) | 15 ml |
| | Ammonium Hexachlororhodate(III) (0.001%) | 10 ml |
| Solution 3-a | Water | 300 ml |
| | Silver Nitrate | 100 g |
| Solution 3-b | Water | 300 ml |
| | Sodium Chloride | 23 g |
| | Potassium Bromide | 10 g |

Compound (P):

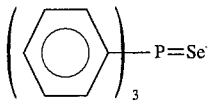

To the emulsion thus obtained, added were 150 mg, per mol of silver in the emulsion (the same shall apply hereunder, unless otherwise specifically indicated), of the sensitizing dye shown in Table 7 below. To this, added were 75 mg of a supersensitizer, disodium 4,4'-bis[2,6-di(2-naphthoxy)-pyrimidin-4-ylamino]-stilbene2,2'-disulfonate, 25 mg of a stabilizer, 1-phenyl-5-mercaptotetrazole, and 6 g of hydroquinone.

To this were further added polyethyl acrylate latex and colloidal silica having a grain size of 0.01 μm each in an amount of 30% by weight relative to the gelatin binder, and 70 mg/m$^2$ of a hardening agent, 2-bis(vinylsulfonylacetamido)ethane. The emulsion thus prepared was coated on a polyester support. The amount of silver coated was 3.2 g/m$^2$, and the amount of gelatin coated was 1.4 g/m$^2$. Along with coating the emulsion layer, an upper protective layer and a lower protective layer each having the composition shown in Table 2 below were coated on the emulsion layer at the same time. The back surface of the support had a backing layer (BC layer) and a backing protective layer (BC protective layer) each having the composition shown in Table 3 below.

TABLE 2

| | amount (per m$^2$) |
|---|---|
| **Lower Protective Layer** | |
| Gelatin | 0.25 g |
| Dye (D) | 250 mg |
| 1,5-Dihydroxy-2-benzaldoxime | 25 mg |
| 5-Chloro-8-hydroxyquinoline | 5 mg |
| Polyethyl Acrylate Latex | 160 mg |
| Sodium Benzenethiosulfonate | 5 mg |
| α-lipoic Acid | 5 mg |
| Compound (E) | 5 mg |
| Compound (F) | 100 mg |
| Polyacrylamide having a mean molecular weight of 5000 | 500 mg |
| **Upper Protective Layer** | |
| Gelatin | 0.25 g |
| Silica Mat Agent having a mean grain size 2.5 μm | 30 mg |
| Silicone Oil | 100 mg |
| Colloidal Silica having a grain size of 10 mμ | 30 mg |
| Compound (G) | 5 mg |
| Sodium Dodecylbenzenesulfonate | 22 mg |

TABLE 3

| | amount (per m$^2$) |
|---|---|
| **BC Layer** | |
| Gelatin | 0.25 g |
| Sodium Dodecylbenzenesulfonate | 20 mg |
| $SnO_2/SbO_2$ (9/1) having a mean grain size of 0.25 μm | 300 mg |
| **BC Protective Layer** | |
| Gelatin | 0.28 g |
| Polymethyl Methacrylate having a mean grain size of 3.5 μm | 50 mg |
| Dye (H) | 35 mg |

TABLE 3-continued

| | |
|---|---|
| Dye (I) | 35 mg |
| Dye (J) | 120 mg |
| Sodium Dodecylbenzenesulfonate | 90 mg |
| Compound (G) | 10 mg |
| 2-Bis(vinylsulfonylacetamido)ethane | 160 mg |

(D)

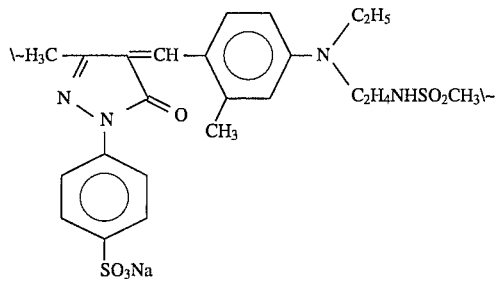

(E)

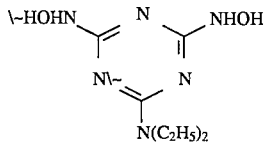

(F)

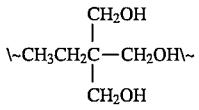

(G)

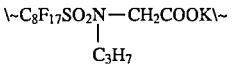

(H)

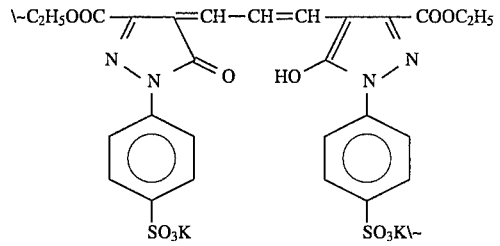

(I)

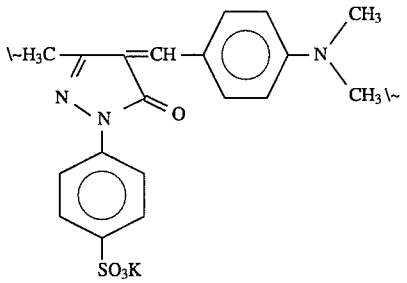

(J)

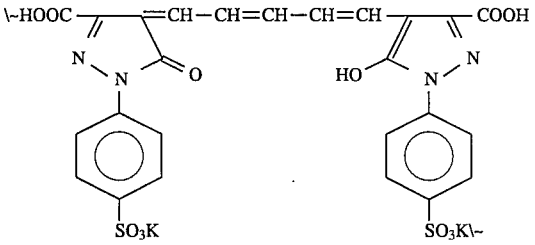

Evaluation of Photographic Properties of Samples:

The samples thus obtained were subjected to sensitometry. Precisely, each sample was exposed to a xenon flash for $10^{-5}$ second, via an interference filter having peaks at 633nm and 670nm and a wedge, and developed under the condition shown in Table 4 below, using an automatic developing machine, FG-710S Model produced by Fuji Photo Film Co. The relative sensitivity of each sample was obtained, corresponding to the reciprocal of the amount of exposure of giving a density of 3.0. The sensitivity of sample No. 7-8 at 633nm and 670nm was standardized to be 100.

The stains, if any, of the processed samples were checked with the naked eye, by which the samples were evaluated by 10-point evaluation. The sample having residual color most had 10 points, while the sample having residual color least had 1 point.

TABLE 4

Process of FG710S

| Step | Temperature | Time |
|---|---|---|
| Insertion | | 2 sec |
| Development | 38° C. | 16 sec |
| Fixation | 37° C. | 16 sec |
| Rinsing | 26° C. | 9 sec |
| Squeegeeing | | 3 sec |
| Drying | 55° C. | 15 sec |
| Total | | 61 sec |

The developer and the fixer used above had the compositions shown in Tables 5 and 6, respectively.

TABLE 5

Composition of Developer

| Component | Amount |
|---|---|
| Sodium 1,2-dihydroxybenzene-3.5-disuifonate | 0.5 g |
| Diethylenetriamine-pentaacetic Acid | 2.0 g |
| Sodium Carbonate | 5.0 g |
| Boric Acid | 10.0 g |
| Potassium Sulfite | 85.0 g |
| Sodium Bromide | 6.0 g |
| Diethylene Glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-Hexahydro-2-thioxo-4-(1H)-quinazolinone | 0.05 g |
| Sodium 2-Mercaptobenzimidazole-5-sulfonate | 0.3 g |
| Potassium hydroxide and water to make | 1 liter, pH 10.7 |

TABLE 6

Composition of Fixer

| Component | Amount |
|---|---|
| Sodium Thiosulfate (anhydride) | 150 g |
| Compound (K) | 0.1 mol |
| Sodium Bisulfite | 30 g |
| Disodium Ethylenediaminetetraacetate Dihydrate | 25 g |
| Sodium hydroxide and water to make | 1 liter, pH 6.0 |

Compound (K):

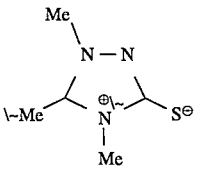

TABLE 7

| Sample No. | Sensitizing Dye | Exposure at 633 nm Sensitivity | Exposure at 633 nm Fog | Exposure at 670 nm Sensitivity | Exposure at 670 nm Fog | Residual Color in Processed Sample | Spectral Sensitivity Peak (nm) | Remarks |
|---|---|---|---|---|---|---|---|---|
| 7-1 | SS-1 | 72 | 0.06 | 58 | 0.06 | 8 | 655 | comparative sample |
| 7-2 | SS-2 | 78 | 0.05 | 10 | 0.05 | 5 | 640 | comparative sample |
| 7-3 | SS-3 | 66 | 0.06 | 66 | 0.06 | 6 | 650 | comparative sample |
| 7-4 | SS-4 | 78 | 0.05 | 78 | 0.05 | 6 | 662 | comparative sample |
| 7-5 | SS-5 | 78 | 0.05 | 78 | 0.05 | 5 | 663 | comparative sample |
| 7-6 | SS-6 | 56 | 0.05 | 81 | 0.0.5 | 6 | 675 | comparative sample |
| 7-7 | SS-7 | 78 | 0.05 | 76 | 0.05 | 6 | 655 | comparative sample |
| 7-8 | (1) | 100 (standard) | 0.05 | 100 (standard) | 0.05 | 1 | 665 | sample of the invention |
| 7-9 | (4) | 94 | 0.05 | 94 | 0.05 | 2 | 662 | sample of the invention |
| 7-10 | (5) | 94 | 0.05 | 94 | 0.05 | 2 | 663 | sample of the invention |
| 7-11 | (8) | 89 | 0.05 | 89 | 0.05 | 3 | 664 | sample of the invention |
| 7-12 | (12) | 83 | 0.05 | 81 | 0.05 | 3 | 651 | sample of the invention |
| 7-13 | (13) | 83 | 0.05 | 81 | 0.05 | 4 | 657 | sample of the invention |
| 7-14 | (20) | 85 | 0.05 | 83 | 0.05 | 3 | 656 | sample of the invention |

Comparative Dyes:

(SS-1)

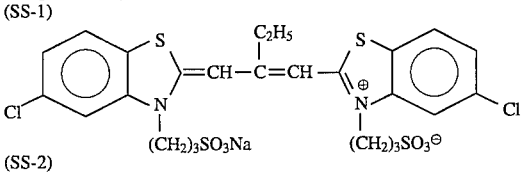

(SS-2)

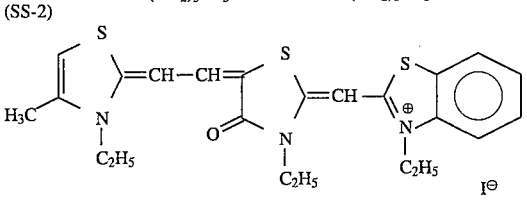

(SS-3)

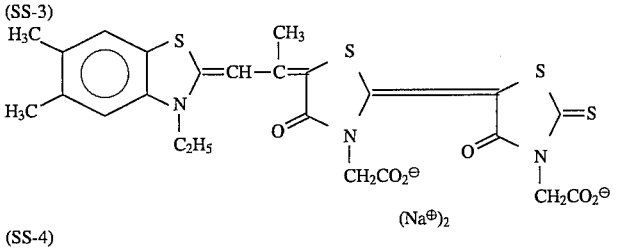

(SS-4)

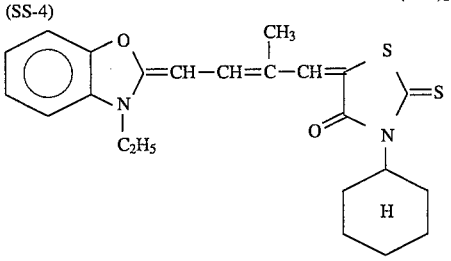

TABLE 7-continued

| Sample No. | Sensitizing Dye | Exposure at 633 nm Sensitivity | Exposure at 633 nm Fog | Exposure at 670 nm Sensitivity | Exposure at 670 nm Fog | Residual Color in Processed Sample | Spectral Sensitivity Peak (nm) | Remarks |
|---|---|---|---|---|---|---|---|---|

(SS-5)

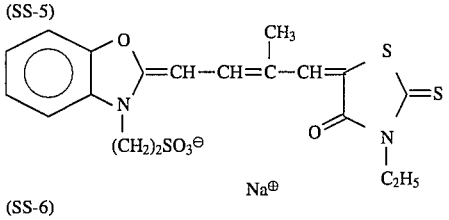

(SS-6)

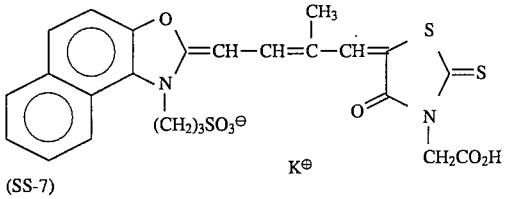

(SS-7)

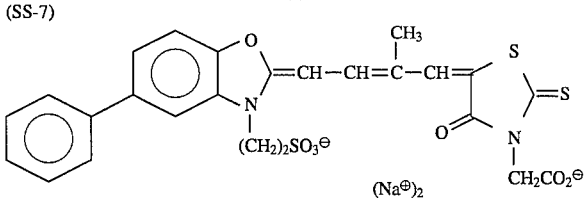

Comparative dye (SS-1) (compound I-1, described in JP-A-3-59637, page 3, left bottom column) had a poor sensitivity balance at 633nm and 670nm. Therefore, the sensitivity of the sample containing this dye was insufficient at 633nm and 670nm, and the sample, after having been processed, had much residual color. This is considered because this dye has J-associability.

Comparative dye (SS-2) (compound II-36, described in JP-A-3-59637, page 9, left top column) also had a poor sensitivity balance at 633nm and 670nm. Therefore, the sensitivity of the sample containing this dye was extremely low at 670nm. In addition, the sample, after having been processed, had much residual color.

Comparative dye (SS-3) (compound I-12, described in U.S. Pat. No. 5,116,722, pp. 7 to 8) had a good sensitivity balance at 633nm and 670nm. However, the sensitivity of the sample containing this dye was insufficient at 633nm and 670nm, and the sample, after having been processed, had much residual color.

Comparative dye (SS-4) (described in U.S. Pat. No. 3,401,404, page 8, Example 11) and comparative dye (SS-5) have no or only one water-soluble group. These had a good sensitivity balance at 633nm and 670nm. However, the sensitivity of the samples containing these dyes were insufficient at 633nm and 670nm, and the samples, after having been processed, had much residual color.

Comparative dye (SS-6) (Compound II-81, described in JP-A-60-131533, page 14, right top column) has a naphthoxazole nucleus. This had a poor sensitivity balance at 633nm and 670nm. Therefore, the sensitivity of the sample containing this dye was insufficient at 633 nm. In addition, the sample, after having been processed, had much residual color.

Comparative dye (SS-7) had a good sensitivity balance at 633nm and 670nm. However, the sensitivity of the sample containing this dye was insufficient at 633nm and 670nm. In addition, the sample, after having been processed, had much residual color.

As opposed to these comparative dyes, dyes (1), (4), (5), (8), (12), (13) and (20) of the present invention all had a gentle color sensitivity distribution in the wavelength range of from 620nm to 690nm. Therefore, the variation in the sensitivity of the sample of the present invention containing any of these dyes was small when the sample was exposed to light having this wavelength range. It is known that sample No. 7-8 through sample No. 7-14 all had a good sensitivity balance at 633 nm and 670nm and therefore had a high sensitivity.

When the dye of formula (I) of the present invention is used, the same photographic material can be exposed with a device having a semiconductor laser source (oscillation wavelength: 670nm). Therefore, the dyes of formula (I) for use in the present invention are extremely advantageous.

From the test results mentioned above, it is also known that sample No. 7-8 through sample No. 7-14 had little residual color after processed.

The absorbance of sample No. 7-8 of the present invention was 0.58 at 633nm and 0.60 at 670nm, and these were almost equivalent. The quantum yield in the color sensitization of this sample was 0.8, from which it is known that the sample had a good sensitivity balance and had a high sensitivity.

The same results as above were also obtained, when the samples shown in Table 7 above were exposed to a He—Ne laser and a semiconductor laser having an oscillating wavelength at 670nm, in place of the interference filter having peaks at 633nm and 670nm.

EXAMPLE 2

The same process as in Example 1 was repeated, except that the development time was shortened to 12 seconds by elevating the line speed of the automatic developing machine. The results obtained are shown in Table 8 below.

TABLE 8

| Sample No. | Sensitizing Dye | Exposure at 633 nm Sensitivity | Exposure at 633 nm Fog | Exposure at 670 nm Sensitivity | Exposure at 670 nm Fog | Residual Color in Processed Sample | /spectral Sensitivity Peak (nm) | Remarks |
|---|---|---|---|---|---|---|---|---|
| 8-1 | SS-1 | 69 | 0.06 | 56 | 0.06 | 10 | 655 | comparative sample |
| 8-2 | SS-2 | 76 | 0.05 | 8 | 0.05 | 6 | 640 | comparative sample |
| 8-3 | SS-3 | 64 | 0.06 | 64 | 0.06 | 7 | 650 | comparative sample |
| 8-4 | SS-4 | 76 | 0.05 | 76 | 0.05 | 7 | 662 | comparative sample |
| 8-5 | SS-5 | 76 | 0.05 | 76 | 0.05 | 6 | 663 | comparative sample |
| 8-6 | SS-6 | 54 | 0.05 | 78 | 0.05 | 7 | 675 | comparative sample |
| 8-7 | SS-7 | 76 | 0.05 | 74 | 0.05 | 7 | 655 | comparative sample |
| 8-8 | (1) | 100 | 0.05 | 100 | 0.05 | 1 | 665 | sample of the invention |
| 8-9 | (4) | 94 | 0.05 | 94 | 0.05 | 2 | 662 | sample of the invention |
| 8-10 | (5) | 94 | 0.05 | 94 | 0.05 | 2 | 663 | sample of the invention |
| 8-11 | (8) | 89 | 0.05 | 89 | 0.05 | 3 | 664 | sample of the invention |
| 8-12 | (12) | 83 | 0.05 | 81 | 0.05 | 3 | 651 | sample of the invention |
| 8-13 | (13) | 83 | 0.05 | 81 | 0.05 | 5 | 657 | sample of the invention |
| 8-14 | (20) | 85 | 0.05 | 83 | 0.05 | 3 | 656 | sample of the invention |

The sensitivity was based on the sensitivity (100) at 633nm and 670nm of sample No. 7-8 in Example 1.

From Table 8 above, it is known that sample No. 8-8 through sample No. 8-14 each containing the sensitizing dye of the present invention still had a sensitivity comparable to the sensitivity of the corresponding samples in Table 7 in Example 1, while having little residual color on the same level as that of the corresponding samples in Table 7, even though the samples were processed rapidly, but sample No. 8-1 through sample No. 8-7 each containing the comparative dye had a lower sensitivity than the sensitivity of the corresponding samples in Table 7 and had more residual color than those of the corresponding samples in Table 7.

Thus, the samples containing the dye of formula (I) of the present invention still had excellent photographic properties even when processed rapidly.

EXAMPLE 3

150 $m^2$ of a film coated with a silver chlorobromide emulsion having a silver chloride content, per mol of silver, of 70 mol % and having a silver content of 3.6 $g/m^2$ was processed in the same automatic developing machine, FG-710S that had been used in the previous examples for evaluation of the sensitivity of the samples, at a blackening percentage of 50%, while replenishing to mother solutions of the developer and the fixer each in an amount of 180 $cc/m^2$. The compositions of the replenishers were the same of the corresponding original bathes. After the process, the machine had fatigued bathes. Using the machine thus having such fatigued bathes, the samples of Example 1 were processed, and the processed samples were evaluated with respect to the sensitivity and residual color. The results obtained are shown in Table 9 below.

TABLE 9

| Sample No. | Sensitizing Dye | Exposure at 633 nm Sensitivity | Exposure at 633 nm Fog | Exposure at 670 nm Sensitivity | Exposure at 670 nm Fog | Residual Color in Processed Sample | Spectral Sensitivity Peak (nm) | Remarks |
|---|---|---|---|---|---|---|---|---|
| 9-1 | SS-1 | 70 | 0.06 | 56 | 0.06 | 9 | 655 | comparative sample |
| 9-2 | SS-2 | 77 | 0.05 | 7 | 0.05 | 6 | 640 | comparative sample |
| 9-3 | SS-3 | 64 | 0.06 | 63 | 0.06 | 8 | 650 | comparative sample |
| 9-4 | SS-4 | 76 | 0.05 | 76 | 0.05 | 7 | 662 | comparative sample |
| 9-5 | SS-5 | 76 | 0.05 | 76 | 0.05 | 6 | 663 | comparative sample |
| 9-6 | SS-6 | 55 | 0.05 | 78 | 0.05 | 7 | 675 | comparative sample |

TABLE 9-continued

| Sample No. | Sensitizing Dye | Exposure at 633 nm Sensitivity | Exposure at 633 nm Fog | Exposure at 670 nm Sensitivity | Exposure at 670 nm Fog | Residual Color in Processed Sample | Spectral Sensitivity Peak (nm) | Remarks |
|---|---|---|---|---|---|---|---|---|
| 9-7 | SS-7 | 77 | 0.05 | 74 | 0.05 | 7 | 655 | comparative sample |
| 9-8 | (1) | 100 | 0.05 | 100 | 0.05 | 1 | 665 | sample of the invention |
| 9-9 | (4) | 94 | 0.05 | 94 | 0.05 | 2 | 662 | sample of the invention |
| 9-10 | (5) | 94 | 0.05 | 94 | 0.05 | 2 | 663 | sample of the invention |
| 9-11 | (8) | 89 | 0.05 | 89 | 0.05 | 3 | 664 | sample of the invention |
| 9-12 | (12) | 83 | 0.05 | 81 | 0.05 | 3 | 651 | sample of the invention |
| 9-13 | (13) | 83 | 0.05 | 81 | 0.05 | 5 | 657 | sample of the invention |
| 9-14 | (20) | 85 | 0.05 | 83 | 0.05 | 3 | 656 | sample of the invention |

From Table 9 above, it is known that sample No. 9-8 through sample No. 9-14 each containing the sensitizing dye of the present invention still had a sensitivity comparable to the sensitivity of the corresponding samples in Table 7 in Example 1, while having little residual color on the same level as that of the corresponding samples in Table 7, even though the amounts of the replenishers added to the processing bathes for processing the samples were reduced, but sample No. 9-1 through sample No. 9-7 each containing the comparative dye had a lower sensitivity than the sensitivity of the corresponding samples in Table 7 and had more residual color than those of the corresponding samples in Table 7.

Thus, the samples containing the dye of formula (I) of the present invention still had excellent photographic properties even though the amounts of the replenishers to be added to the processing bathes for processing the samples were reduced.

EXAMPLE 4

Preparation of Emulsions:

| | |
|---|---|
| **Solution 1:** | |
| Water | 750 ml |
| Gelatin | 20 g |
| Sodium Chloride | 3 g |
| 1,3-Dimethylimidazolidine-2-thione | 20 mg |
| Sodium Thiosulfonate | 10 mg |
| **Solution 2:** | |
| Water | 300 ml |
| Silver Nitrate | 150 g |
| **Solution 3:** | |
| Water | 300 ml |
| Sodium Chloride | 34 g |
| Potassium Bromide | 32 g |
| Potassium Hexachloroiridate | 0.25 mg |
| Ammonium Hexabromorhodate | 0.06 mg |

90% of solution 2 and 90% of solution 2-b were added to solution 1 that had been kept at 38° C. and at pH of 4.5, with stirring by a double jet method over a period of 20 minutes, thereby forming core grains having a grain size of 0.20 μm. Next solution 4 and solution 5 mentioned below were added thereto over a period of 8 minutes, by which the core grains were grown to have a grain size of 0.24 μm. Then, the remaining amounts (10%) of solution 2 and solution 3 Were added thereto over a period of 2 minutes, by which the grains were further grown to have a grain size of 0.25 μm. In addition, 0.15 g of potassium iodide were added thereto to complete the formation of the intended grains.

| | |
|---|---|
| **Solution 4:** | |
| Water | 100 ml |
| Silver Nitrate | 50 g |
| **Solution 5:** | |
| Water | 100 ml |
| Sodium Chloride | 14 mg |
| Potassiun Bromide | 11 mg |
| Potassium Ferrocyanide | 5 mg |

Afterwards, the grains were washed with water by conventional flocculation. 40 g of gelatin were added thereto. The resulting emulsion was adjusted at pH of 5.8 and at pAg of 7.5. One mg of sodium thiosulfate, 1 mg of compound (a) mentioned below and 5 mg of chloroauric acid were added thereto, and the emulsion was chemically sensitized at 55° C. to have the optimum sensitivity. 200 mg of a stabilizer, 1,3,3a,7-tetrazaindene and 100 ppm of an antiseptic, phenoxyethanol were added thereto.

Finally obtained was an emulsion of cubic silver iodochlorobromide grains having a silver chloride content of 70 mol %, a silver iodide content of 0.08 mol %, a mean grain size of 0.25 μm and a fluctuation coefficient of 9 %.

To the emulsion thus obtained, added were $5.5\times10^{-4}$ mol, per mol of silver in the emulsion (the same shall apply hereunder, unless otherwise specifically indicated), of the sensitizing dye shown in Table 12 below, 5 g of KBr, 5 g of KI, 5 g of hydroquinone, 0.4 g of compound [b] mentioned below and 0.1 g of compound [c] also mentioned below.

[a]

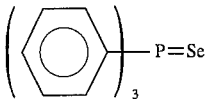

[b]

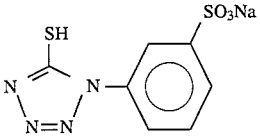

[c]

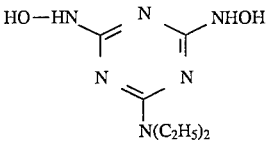

[d]

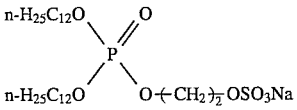

(Z-1)

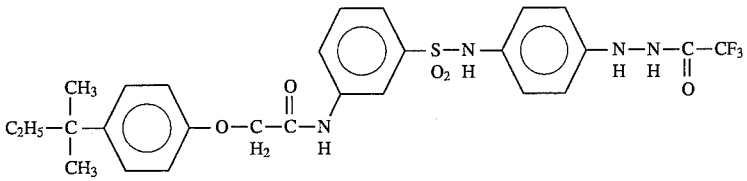

(Z-2)

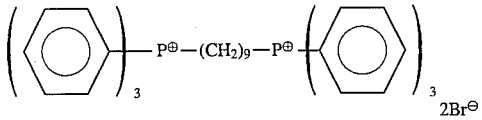

To this were further added 0.3 g of a nucleating agent, compound (Z-1) mentioned above and 0.2 g of a nucleation accelerator, compound (Z-2) also mentioned above. In addition, also added to this were 0.2 g of compound [d] mentioned above, 0.4 g of sodium dodecylbenzenesulfonate, polyethyl acrylate latex and colloidal silica having a grain size of 0.01 μm each in an amount of 30% by weight relative to the gelatin binder, and a hardening agent, 2-bis(vinylsulfonylacetamido)ethane in an amount of 4% by weight relative to the gelatin binder. The emulsion thus prepared was coated on a polyester support. The amount of silver coated was 3.2 g/m$^2$, and the amount of gelatin coated was 1.4 g/m$^2$.

Along with coating the emulsion layer, an upper protective layer, a lower protective layer and a subbing layer each having the composition shown in Table 10 below were coated at the same time. The back surface of the support had a BC layer and a BC protective layer each having the composition shown in Table 11 below.

TABLE 10

| | amount (per m$^2$) |
|---|---|
| Lower Protective Layer | |
| Gelatin | 0.5 g |
| 1,5-Dihydroxy-2-benzaldoxime | 25 mg |
| α-lipoic Acid | 5 mg |
| Polyethyl Acrylate Latex | 160 mg |
| Upper Protective Layer | |
| Gelatin | 0.3 g |

TABLE 10-continued

| | amount (per m$^2$) |
|---|---|
| Silica Mat Agent having a mean grain size of 2.5 μm | 30 mg |
| Silicone Oil | 30 mg |
| Colloidal Silica having a grain size of 0.01 μm | 30 mg |
| N-perfluorooctanesulfonyl-N-propylglycine Potassium Salt | 10 mg |
| Sodium Dodecylbenzenesulfonate | 25 mg |
| Subbing Layer | |
| Gelatin | 0.5 g |
| Dye [e] mentioned below | 20 mg |
| N-oleyl-N-methyltaurine Sodium Salt | 10 mg |

TABLE 11

| | amount (per $m^2$) |
|---|---|
| **BC Layer** | |
| Gelatin | 0.25 g |
| Sodium Dodecylbenzenesulfonate | 20 mg |
| $SnO_2/SbO_2$ (9/1) having a mean grain size of 0.25 μm | 200 mg |
| **BC Protective Layer** | |
| Gelatin | 3.0 g |
| Polymethyl Methacrylate having a mean grain size of 3.5 μm | 50 m |
| Dye [f] mentioned below | 35 mg |
| Dye [g] mentioned below | 35 mg |
| Dye [h] mentioned below | 120 mg |
| Sodium Acetate | 80 mg |
| Sodium Dodecylbenzenesulfonate | 90 mg |
| 2-Bis(vinylsulfonylacetamido)ethane | 160 mg |

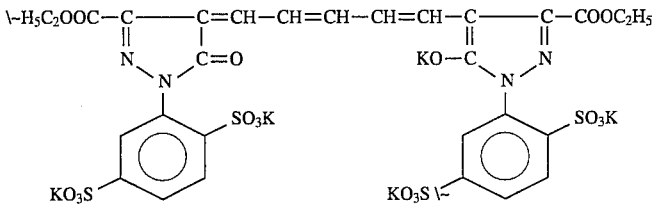

[e]

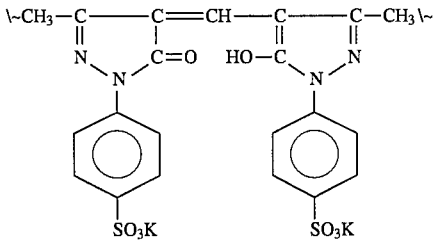

Dye [f]

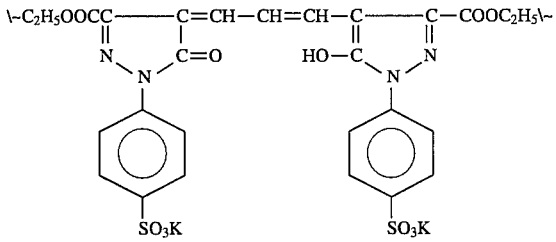

Dye [g]

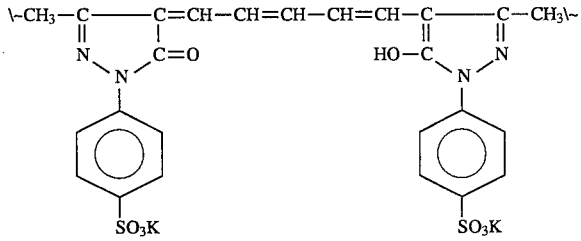

Dye [h]

Evaluation of Photographic Properties of Samples:

The samples thus obtained were subjected to sensitometry. Precisely, each sample was exposed to a xenon flash for $10^{-6}$ second, via an interference filter having peaks at 633nm and 670nm and a step wedge, and developed with an automatic developing machine, FG-680AG Model produced by Fuji Photo Film Co, at 35° C. for 30 seconds.

The relative sensitivity of each sample was obtained, corresponding to the reciprocal of the amount of exposure of giving a density of 1.5. The sensitivity of sample No. 12-8 at 633nm and 670nm was standardized to be 100.

The stains, if any, of the processed samples were checked with the naked eye, by which the samples were evaluated by 10-point evaluation in the same manner as in Example 1.

The composition of the developer used is mentioned below.

| Composition of Developer: | |
|---|---|
| Potassium Hydroxide | 35 g |
| Diethylenetriamine-pentaacetic Acid | 2 g |
| Potassium Carbonate | 40 g |
| Sodium Metabisulfite | 40 g |
| Potassium Bromide | 3 g |

-continued

| Composition of Developer: | |
|---|---|
| Hydroquinone | 25 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazolinone | 0.04 g |
| Sodium 2-Mercaptobenzimidazole-5-sulfonate | 0.15 g |
| Sodium Erysorbate | 3 g |
| Diethylene Glycol | 20 g |
| Potassium hydroxide and water to make | 1 liter, pH 10.45 |

The composition of the fixer used is mentioned below.

| Composition of Fixer: | |
|---|---|
| Ammonium Thiosulfate | 359 g |
| Disodium Ethylenediamine-tetraacetate Dihydrate | 2.3 g |
| Sodium Thiosulfate Pentahydrate | 33 g |
| Sodium Sulfite | 75 g |
| NaOH | 37 g |
| Glacial Acetic Acid | 87 g |
| Tartaric Acid | 8.8 g |
| Sodium Gluconate | 6.6 g |
| Aluminium Sulfate | 25 g |
| pH (adjusted with sulfuric acid or sodium hydroxide) | 5.05 |
| Water to make | 1 liter |

TABLE 12

| Sample No. | Sensitizing Dye | Exposure at 633 nm Sensitivity | Exposure at 633 nm Fog | Exposure at 670 nm Sensitivity | Exposure at 670 nm Fog | Residual Color In Processed Sample | Spectral Sensitivity Peak (nm) | Remarks |
|---|---|---|---|---|---|---|---|---|
| 12-1 | SS-1 | 70 | 0.07 | 57 | 0.07 | 9 | 655 | comparative sample |
| 12-2 | SS-2 | 77 | 0.05 | 10 | 0.05 | 5 | 640 | comparative sample |
| 12-3 | SS-3 | 65 | 0.06 | 63 | 0.06 | 7 | 650 | comparative sample |
| 12-4 | SS-4 | 75 | 0.07 | 75 | 0.07 | 6 | 662 | comparative sample |
| 12-5 | SS-5 | 78 | 0.05 | 78 | 0.05 | 5 | 663 | comparative sample |
| 12-6 | SS-6 | 52 | 0.05 | 77 | 0.05 | 6 | 675 | comparative sample |
| 12-7 | SS-7 | 76 | 0.05 | 76 | 0.05 | 7 | 655 | comparative sample |
| 12-8 | (1) | 100 (standard) | 0.05 | 100 (standard) | 0.05 | 1 | 665 | sample of the invention |
| 12-9 | (4) | 93 | 0.05 | 93 | 0.05 | 2 | 662 | sample of the invention |
| 12-10 | (5) | 94 | 0.05 | 94 | 0.05 | 2 | 663 | sample of the invention |
| 12-11 | (8) | 87 | 0.05 | 87 | 0.05 | 3 | 664 | sample of the invention |
| 12-12 | (12) | 82 | 0.05 | 81 | 0.05 | 3 | 651 | sample of the invention |
| 12-13 | (13) | 82 | 0.05 | 80 | 0.05 | 4 | 657 | sample of the invention |
| 12-14 | (20) | 84 | 0.05 | 83 | 0.05 | 3 | 656 | sample of the invention |

From Table 12 above, it is known that sample No. 12-8 through sample No. 12-14 each containing the sensitizing dye of the present invention are superior to sample No. 12-1 through sample No. 12-7 each containing the comparative dye, as having a better sensitivity balance at 633nm and 670nm and having a higher sensitivity than the latter. In addition, after having been processed, the samples of the present invention had less residual color than the comparative samples.

The same results as above were also obtained, when the samples shown in Table 12 above were exposed to a He—Ne laser and a semiconductor laser having an oscillating wavelength at 670nm, in place of the interference filter having peaks at 633nm and 670nm.

As has been described in detail hereinabove, the silver halide photographic material containing a sensitizing dye having a particular structure of the present invention is highly sensitive to laser rays having an oscillating wavelength range of from 620nm to 690nm. After processed, the material has little residual color. The material can be processed rapidly or can be processed with an automatic developing machine while adding reduced amounts of replenishers thereto.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon a silver halide emulsion layer containing at least one compound represented by formula (I)

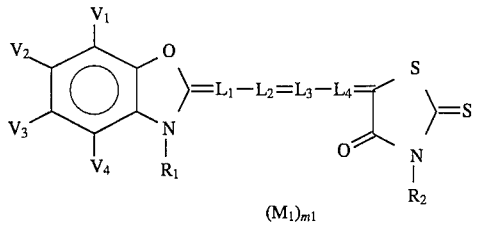

(I)

wherein $R_1$ and $R_2$ each represents an alkyl group having a water-solubilizing group in free acid form or in salt form;

$V_1$, $V_2$, $V_3$ and $V_4$ each represents a hydrogen atom or a monovalent substituent, provided that $V_1$, $V_2$, $V_3$ and $V_4$ are not bonded to each other to form a ring and that the sum of the molecular weights of $V_1$, $V_2$, $V_3$ and $V_4$ is from 4 to 50;

$L_1$, $L_2$, $L_3$ and $L_4$ each represents a methine group;

$M_1$ represents a charge-neutralizing pair ion; and $m_1$ represents a number of from 0 to 4 that is necessary for neutralizing the intramolecular charge.

2. The silver halide photographic material as claimed in claim 1, wherein said at least one compound of formula (I) is selected from compounds represented by formula (II)

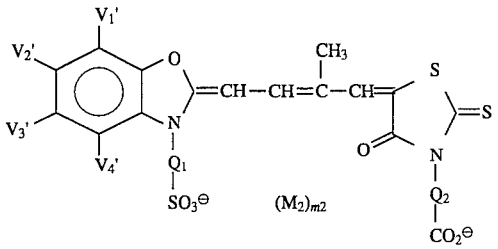

(II)

wherein $Q_1$ and $Q_2$ each represents an alkylene group;

$V_1'$, $V_2'$, $V_3'$ and $V_4'$ each represents a hydrogen atom, a methyl group, a methoxy group, a hydroxyl group, an acetyl group, a fluorine atom or a chlorine atom, provided that the sum of the molecular weights of $V_1'$, $V_2'$, $V_3'$ and $V_4'$ is from 4 to 50;

$M_2$ represents a charge-neutralizing pair ion; and $m_2$ represents a number of from 0 to 4 that is necessary for neutralizing the intramolecular charge.

3. A method for exposing a silver halide photographic material to at least one laser source having an oscillating wavelength of from 620nm to 690nm, wherein said silver halide photographic material comprises a support having provided thereon a silver halide emulsion layer containing at least one compound represented by formula (I)

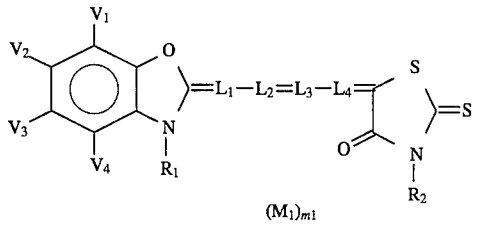

(I)

wherein $R_1$ and $R_2$ each represents an alkyl group having a water-solubilizing group in free acid form or in salt form; $V_1$, $V_2$, $V_3$ and $V_4$ each represents a hydrogen atom or a monovalent substituent, provided that $V_1$, $V_2$, $V_3$ and $V_4$ are not bonded to each other to form a ring and that the sum of the molecular weights of $V_1$, $V_2$, $V_3$ and $V_4$ is from 4 to 50;

$L_1$, $L_2$, $L_3$ and $L_4$ each represents a methine group;

$M_1$ represents a charge-neutralizing pair ion; and $m_1$ represents a number of from 0 to 4 that is necessary for neutralizing the intramolecular charge.

4. The method for exposing a silver halide photographic material as claimed in claim 3, wherein said silver halide photographic material is exposed with 2 to 5 laser sources having an oscillating wavelength of from 620 nm to 690nm.

5. The method for exposing a silver halide photographic material as claimed in claim 4, wherein said silver halide photographic material is exposed with 2 to 5 laser sources including at least a He—Ne laser and a semiconductor laser having an oscillating wavelength of 670 nm±10nm.

6. A method for processing an imagewise-exposed silver halide photographic material with an automatic developing machine while adding replenishers to a developer bath and to a fixer bath each in an amount of from 50 to 200 cc/$m^2$, wherein said silver halide photographic material comprises a support having provided thereon a silver halide emulsion layer containing at least one compound represented by formula (I)

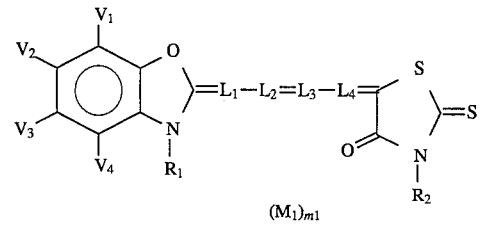

(I)

wherein $R_1$ and $R_2$ each represents an alkyl group having a water-solubilizing group in free acid form or in salt form;

$V_1$, $V_2$, $V_3$ and $V_4$ each represents a hydrogen atom or a monovalent substituent, provided that $V_1$, $V_2$, $V_3$ and $V_4$ are not bonded to each other to form a ring and that the sum of the molecular weights of $V_1$, $V_2$, $V_3$ and $V_4$ is from 4 to 50;

$L_1$, $L_2$, $L_3$ and $L_4$ each represents a methine group;

$M_1$ represents a charge-neutralizing pair ion; and $m_1$ represents a number of from 0 to 4 that is necessary for neutralizing the intramolecular charge.

7. A method for processing an imagewise-exposed silver halide photographic material with an automatic developing machine within 15 seconds to 60 seconds as the total processing time, wherein said silver halide photographic material comprises a support having provided thereon a silver halide emulsion layer containing at least,one compound represented by formula (I)

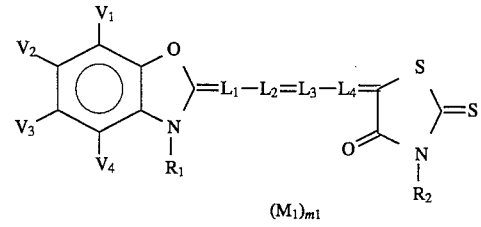

(I)

wherein $R_1$ and $R_2$ each represents an alkyl group having a water-solubilizing group in free acid form or in salt form;

$V_1$, $V_2$, $V_3$ and $V_4$ each represents a hydrogen atom or a monovalent substituent, provided that $V_1$, $V_2$, $V_3$ and $V_4$ are not bonded to each other to form a ring and that the sum of the molecular weights of $V_1$, $V_2$, $V_3$ and $V_4$ is from 4 to 50;

$L_1$, $L_2$, $L_3$ and $L_4$ each represents a methine group;

$M_1$ represents a charge-neutralizing pair ion; and $m_1$ represents a number of from 0 to 4 that is necessary for neutralizing the intramolecular charge.

* * * * *